US009562341B2

(12) United States Patent
Voelz

(10) Patent No.: US 9,562,341 B2
(45) Date of Patent: Feb. 7, 2017

(54) DIPPER DROP DETECTION AND MITIGATION IN AN INDUSTRIAL MACHINE

(71) Applicant: Harnischfeger Technologies, Inc., Wilmington, DE (US)

(72) Inventor: Nicholas R. Voelz, West Allis, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 0 days.

(21) Appl. No.: 14/695,294

(22) Filed: Apr. 24, 2015

(65) Prior Publication Data

US 2016/0312435 A1 Oct. 27, 2016

(51) Int. Cl.

| | |
|---|---|
| ***E02F 3/43*** | (2006.01) |
| ***E02F 3/30*** | (2006.01) |
| ***E02F 3/42*** | (2006.01) |
| ***E02F 9/20*** | (2006.01) |

(52) U.S. Cl.

CPC ..... *E02F 3/435* (2013.01); *E02F 3/308* (2013.01); *E02F 3/425* (2013.01); *E02F 9/2004* (2013.01); *E02F 9/2041* (2013.01)

(58) Field of Classification Search

USPC ..... 701/50

See application file for complete search history.

(56) References Cited

U.S. PATENT DOCUMENTS

| | | | |
|---|---|---|---|
| 4,278,393 | A | 7/1981 | Baron |
| 4,370,713 | A | 1/1983 | McCoy, Jr. et al. |
| 4,677,579 | A | 6/1987 | Radomilovich |
| 5,408,767 | A | 4/1995 | Hazama et al. |
| 6,025,686 | A | 2/2000 | Wickert et al. |
| 6,466,850 | B1 | 10/2002 | Hilgart |
| 7,181,370 | B2 | 2/2007 | Furem et al. |
| 7,406,399 | B2 | 7/2008 | Furem et al. |
| 8,065,060 | B2 | 11/2011 | Danko |
| 8,355,847 | B2 | 1/2013 | Colwell et al. |
| 8,571,766 | B2 | 10/2013 | Colwell et al. |
| 8,620,536 | B2 | 12/2013 | Colwell et al. |

(Continued)

OTHER PUBLICATIONS

First Office Action from the State Intellectual Property Office of China for Application No. 201620356104.0 dated Jul. 29, 2016 (3 pages).

(Continued)

*Primary Examiner* — Anne M Antonucci

(74) *Attorney, Agent, or Firm* — Michael Best & Friedrich LLP

(57) ABSTRACT

An industrial machine that includes a dipper, a user interface, a sensor, a hoist actuator, and a controller. The user interface is operable to generate a first signal related to a requested characteristic of the industrial machine. The sensor is operable to generate a second signal related to an actual characteristic of the industrial machine. The hoist actuator has at least one operating parameter. The controller is configured to receive the first signal related to the actual characteristic, receive the second signal related to the requested characteristic, compare the requested characteristic to the actual characteristic to detect a dipper drop condition, and modify a setting of the at least one operating parameter of the hoist actuator after the dipper drop condition is detected. The dipper drop condition is detected after the requested characteristic does not match the actual characteristic

22 Claims, 5 Drawing Sheets

(56) References Cited

U.S. PATENT DOCUMENTS

| | | | | |
|---|---|---|---|---|
| 8,744,696 | B2 | 6/2014 | Choi | |
| 8,825,315 | B2 | 9/2014 | Colwell et al. | |
| 8,825,317 | B2 | 9/2014 | Colwell et al. | |
| 2007/0168100 | A1* | 7/2007 | Danko | B25J 9/1628 701/50 |
| 2013/0110460 | A1 | 5/2013 | Taylor | |
| 2013/0138305 | A1 | 5/2013 | Colwell et al. | |
| 2014/0188351 | A1 | 7/2014 | Colwell et al. | |
| 2014/0277964 | A1 | 9/2014 | Rikkola et al. | |
| 2015/0308073 | A1 | 10/2015 | Voelz et al. | |

OTHER PUBLICATIONS

Second Office Action from the State Intellectual Property Office of China for Application No. 201620356104.0 dated Oct. 17, 2016 (3 pages, which includes a Statement of Relevance).

* cited by examiner

DIPPER DROP DETECTION AND MITIGATION IN AN INDUSTRIAL MACHINE

BACKGROUND

This invention relates to controlling the operation of an industrial machine, such as an electric rope or power shovel.

SUMMARY

Industrial machines, such as electric rope shovels, are used to execute digging operations to remove material from, for example, a bank of a mine. During digging operations, machine faults and/or operator error can result in a component or dipper suddenly and uncontrollably dropping. Such uncontrolled movements are very dangerous and harmful, and typically result in the industrial machine having to be shut down to determine the cause of the dipper drop. Industrial machine downtime increases costs both in terms of lost production and the logistics of changing planned digging operations.

A variety of characteristics or parameters of the industrial machine can be monitored to identify when a dipper is dropping or has dropped. When a dipper drop condition has been identified or detected a corrective action is taken to eliminate or mitigate the harmful effects of the dipper drop condition. Depending upon the severity of the event, different corrective actions can be taken. For example, for less severe dipper drop events, the industrial machine can modify or control applied torques to mitigate the drop and keep the machine running without an operator noticing the event. For more severe dipper drop events, the industrial machine can automatically set hoist brakes to catch the dipper. By identifying and correcting dipper drop conditions more quickly than an operator would otherwise be able, damage to the industrial machine and potential injuries to bystanders can be prevented or mitigated.

In some embodiments, the industrial machine monitors or determines hoist torque, hoist speed, dipper position, etc., to determine whether a dipper drop condition is present. These conditions can be compared to expected or requested values to determine whether the industrial machine is operating as requested or if a dipper drop condition is present. In some embodiments, the presence of a generating torque when a motoring torque is expected is used to identify a dipper drop condition. In other embodiments, hoist rope pay-out/pay-in can be monitored to identify a dipper drop condition. In addition to modifying torque and setting brakes to mitigate a dipper drop condition, the industrial machine can also execute a soft-lower of the dipper, crowd out the dipper to stall in a bank, or swing the dipper clear of a truck to protect the truck driver and the truck from injury or damage.

Embodiments of the invention provide a system for controlling the operation of an industrial machine during a dipper drop condition. The system includes a controller that monitors and compares a hoist characteristic of the industrial machine (e.g., hoist speed) with a requested hoist characteristic. If the controller determines that the actual hoist characteristic is different than the requested behavior, the controller adjusts a hoist parameter, such as a hoist torque, to resolve or mitigate the dipper drop condition. If the dipper drop condition cannot be resolved by adjusting the hoist parameter, the controller can perform further actions, such as setting the brakes for one or more system motors.

In one embodiment, the invention provides an industrial machine that includes a dipper, a user interface, a sensor, a hoist actuator, and a controller. The user interface is operable to generate a first signal related to a requested characteristic of the industrial machine based on an operator input. The sensor is operable to generate a second signal related to an actual characteristic of the industrial machine. The hoist actuator has at least one operating parameter. The controller is configured to receive the first signal related to the actual characteristic of the industrial machine, receive the second signal related to the requested characteristic of the industrial machine, compare the requested characteristic of the industrial machine to the actual characteristic of the industrial machine to detect a dipper drop condition, and modify a setting of the at least one operating parameter of the hoist actuator after the dipper drop condition is detected. The dipper drop condition is detected after the requested characteristic of the industrial machine does not match the actual characteristic of the industrial machine In another embodiment, the invention provides a method of controlling an industrial machine including a dipper. The method includes receiving a first signal related to an actual characteristic of the industrial machine from a sensor, receiving a second signal related to a requested characteristic of the industrial machine based on an operator input to a user interface, comparing the requested characteristic of the industrial machine to the actual characteristic of the industrial machine to detect a dipper drop condition, and modifying a setting of at least one operating parameter of a hoist actuator after the dipper drop condition is detected. The dipper drop condition is detected after the requested characteristic of the industrial machine does not match the actual characteristic of the industrial machine.

In another embodiment, the invention provides an industrial machine that includes a component, a user interface, a sensor, an actuator, and a controller. The user interface is operable to generate a signal related to a requested characteristic of the industrial machine based on an operator input. The sensor is operable to generate a first signal related to an actual characteristic of the industrial machine. The actuator has at least one operating parameter. The controller is configured to receive the first signal related to the actual characteristic of the industrial machine, receive the second signal related to the requested characteristic of the industrial machine, compare the requested characteristic of the industrial machine to the actual characteristic of the industrial machine to detect a component drop condition, and modify a setting of the at least one operating parameter of the actuator after the component drop condition is detected. The component drop condition is detected after the requested characteristic of the industrial machine does not match the actual characteristic of the industrial machine.

Before any embodiments of the invention are explained in detail, it is to be understood that the invention is not limited in its application to the details of the configuration and arrangement of components set forth in the following description or illustrated in the accompanying drawings. The invention is capable of other embodiments and of being practiced or of being carried out in various ways. Also, it is to be understood that the phraseology and terminology used herein are for the purpose of description and should not be regarded as limiting. The use of "including," "comprising," or "having" and variations thereof herein are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (e.g., stored on non-transitory computer-readable medium) executable by one or more processing units, such as a microprocessor and/or application specific integrated circuits ("ASICs"). As such, it should be noted that a plurality of hardware and software based devices, as well as a plurality of different structural components may be utilized to implement the invention. For example, "servers" and "computing devices" described in the specification can include one or more processing units, one or more computer-readable medium modules, one or more input/output interfaces, and various connections (e.g., a system bus) connecting the components.

Other aspects of the invention will become apparent by consideration of the detailed description and accompanying drawings.

DETAILED DESCRIPTION

The invention described herein relates to systems, methods, devices, and computer readable media associated with the dynamic control of an industrial machine (e.g., controlling one or more settings or parameters of the industrial machine). The industrial machine, such as an electric rope shovel or similar mining machine, is operable to execute a digging operation to remove a payload (e.g., material, etc.) from a bank. During the execution of a digging operation, machine faults and/or operator error can result in a component (e.g., a dipper) suddenly and uncontrollably dropping. Under a component or dipper drop condition, an operator temporarily loses control of the dipper's movement such that actual dipper movement (e.g., down) does not correspond to an operator-requested dipper movement (e.g., up). In order to prevent such a situation, a control system of the industrial machine is configured to dynamically control a parameter (e.g., a hoist force, a hoist motor torque, a hoist motor speed, etc.) related to preventing or mitigating the dipper drop condition. As an illustrative example, to prevent or mitigate a dipper drop condition, a hoist parameter (e.g., a hoist torque, etc.) can be modified to compensate for the difference between an actual and requested parameter (e.g., direction of hoist speed, direction of dipper movement, etc.). Following the modification of the hoist parameter of the industrial machine, the operation of the industrial machine continues to be monitored to determine if the dipper drop condition has been prevented or mitigated. If the dipper drop condition has not been mitigated in a given period, the industrial machine can set brakes or take another action to control the movement of the dipper.

Figure 1:
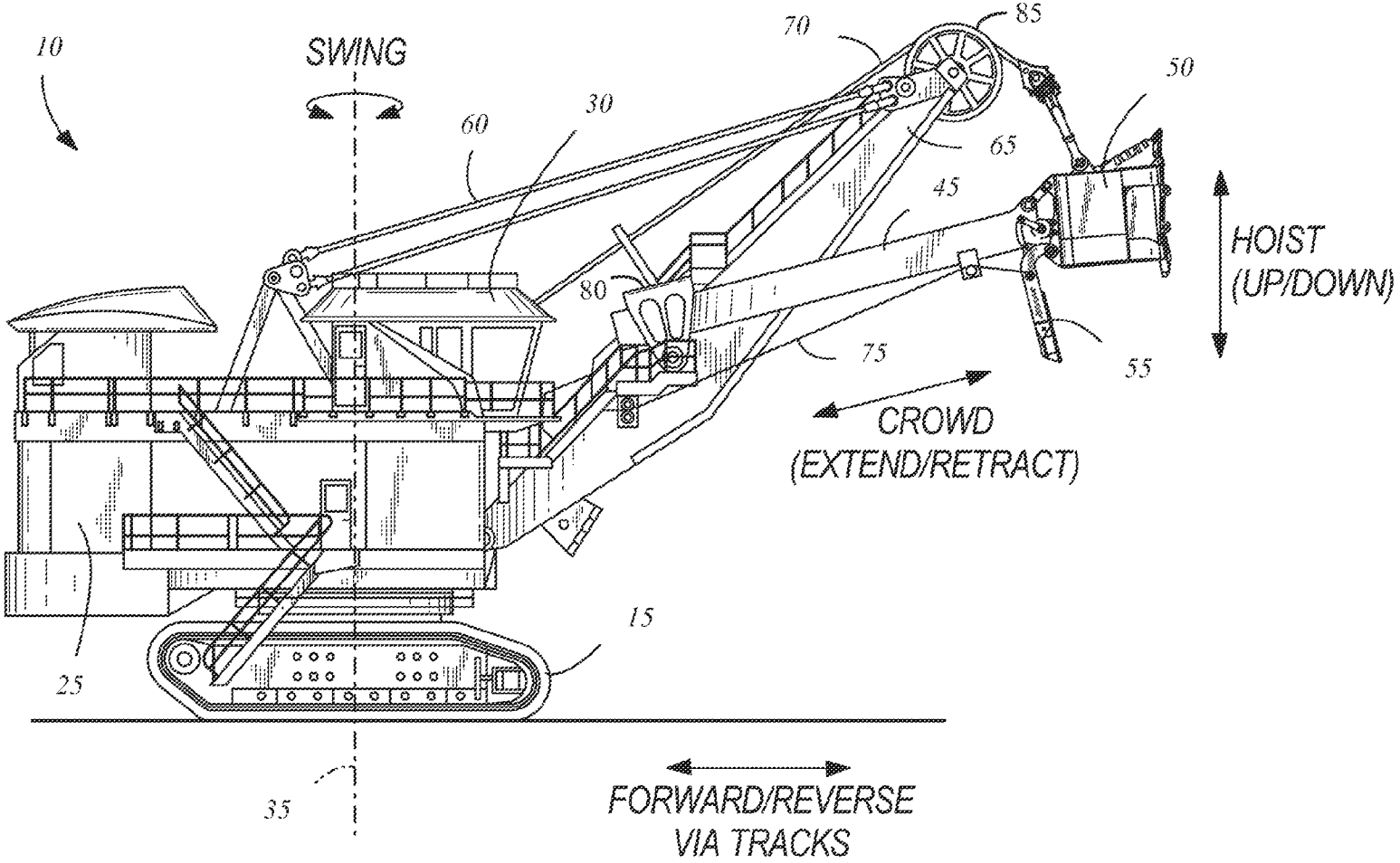
FIG. 1 illustrates an industrial machine according to an embodiment of the invention.

Although the invention described herein can be applied to, performed by, or used in conjunction with a variety of industrial machines (e.g., a rope shovel, a dragline, AC machines, DC machines, etc.), embodiments of the invention described herein are described with respect to an electric rope or power shovel, such as the shovel 10 shown in FIG. 1. The shovel 10 includes tracks 15 for propelling the shovel 10 forward and backward, and for turning the shovel 10 (i.e., by varying the speed and/or direction of left and right tracks relative to each other). The tracks 15 support a base 25 including a cab 30. The base 25 is able to swing or swivel about a swing axis 35, for instance, to move from a digging location to a dumping location. Movement of the tracks 15 is not necessary for the swing motion. The shovel 10 further includes a pivotable dipper handle 45 and dipper 50. The dipper 50 includes a door 55 for dumping contents of the dipper 50.

The shovel 10 includes suspension cables 60 coupled between the base 25 and a boom 65 for supporting the boom 65. The rope shovel also include a wire rope or hoist cable 70 attached to a winch and hoist drum within the base 25 for winding the hoist cable 70 to raise and lower the dipper 50, and a dipper trip cable 75 connected between another winch (not shown) and the dipper door 55. The shovel 10 also includes a saddle block 80 and a sheave 85. In some embodiments, the shovel 10 is a P&H® 4100 series shovel produced by Joy Global Inc.

Figure 2:
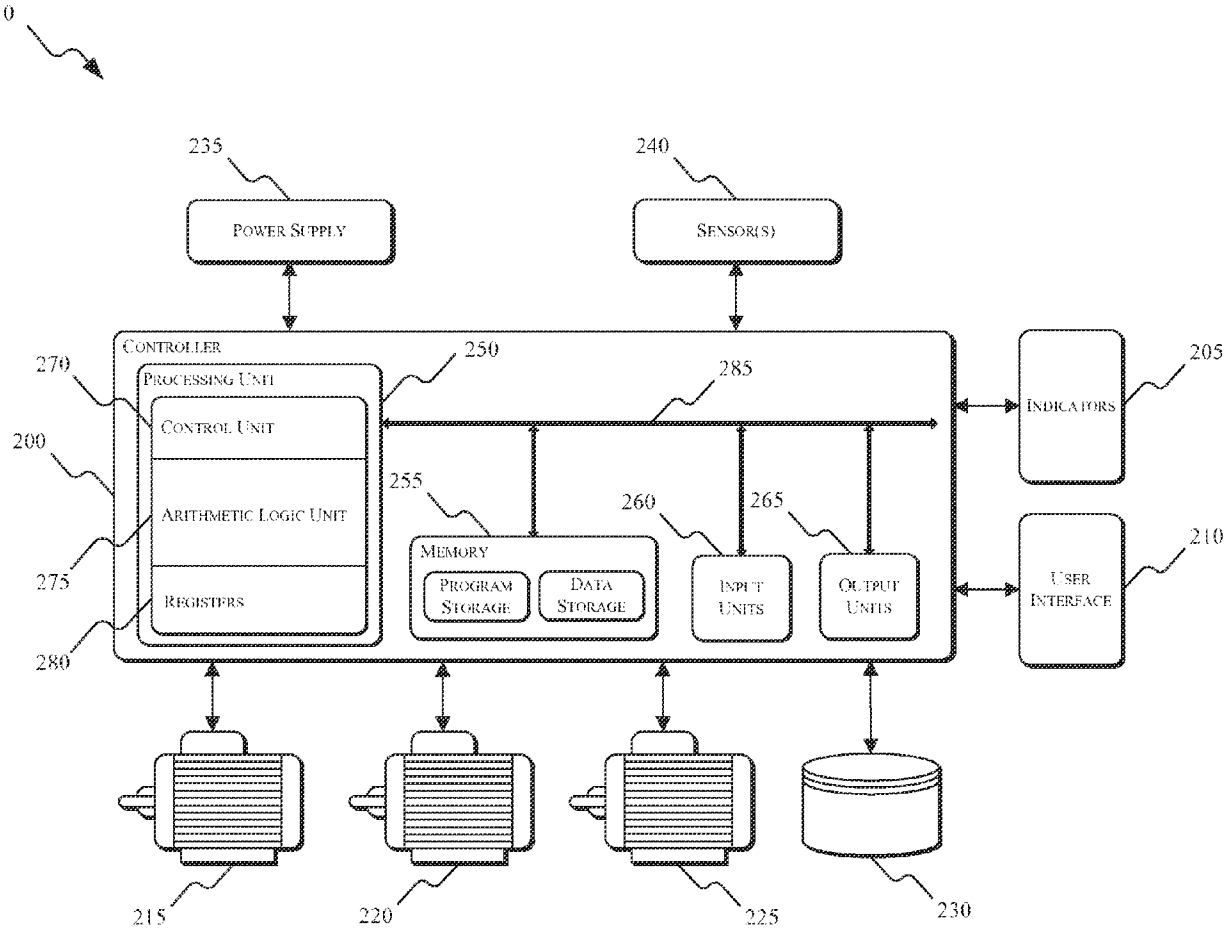
FIG. 2 illustrates a control system of the industrial machine of FIG. 1 according to an embodiment of the invention.

FIG. 2 illustrates a controller 200 associated with the shovel 10 of FIG. 1 or another industrial machine. The controller 200 is electrically and/or communicatively connected to a variety of modules or components of the industrial machine 10. For example, the illustrated controller 200 is connected to one or more indicators 205, a user interface module 210, one or more hoist actuators or motors and hoist drives 215, one or more crowd actuators or motors and crowd drives 220, one or more swing actuators or motors and swing drives 225, a data store or database 230, a power supply module 235, and one or more sensors 240. The controller 200 includes combinations of hardware and software that are operable to, among other things, control the operation of the industrial machine 10, control the position of the boom 65, the dipper handle 45, the dipper 50, etc., activate the one or more indicators 205 (e.g., a liquid crystal display ["LCD"]), monitor the operation of the industrial machine 10, etc. The one or more sensors 240 include, among other things, a loadpin strain gauge, one or more inclinometers, gantry pins, one or more motor field modules, one or more resolvers, etc. In some embodiments, a crowd drive other than a crowd drive for a motor can be used (e.g., a crowd drive for a single legged handle, a stick, a hydraulic cylinder, etc.).

In some embodiments, the controller 200 includes a plurality of electrical and electronic components that provide power, operational control, and protection to the components and modules within the controller 200 and/or industrial machine 10. For example, the controller 200 includes, among other things, a processing unit 250 (e.g., a microprocessor, a microcontroller, or another suitable programmable device), a memory 255, input units 260, and output units 265. The processing unit 250 includes, among other things, a control unit 270, an arithmetic logic unit ("ALU") 275, and a plurality of registers 280 (shown as a group of registers in FIG. 2), and is implemented using a known computer architecture, such as a modified Harvard architecture, a von Neumann architecture, etc. The processing unit 250, the memory 255, the input units 260, and the output units 265, as well as the various modules connected to the controller 200 are connected by one or more control and/or data buses (e.g., common bus 285). The control and/or data buses are shown generally in FIG. 2 for illustrative purposes. The use of one or more control and/or data buses for the interconnection between and communication among the various modules and components would be known to a person skilled in the art in view of the invention described herein. In some embodiments, the controller 200 is implemented partially or entirely on a semiconductor chip, is a field-programmable gate array ("FPGA"), is an application specific integrated circuit ("ASIC"), etc.

The memory 255 includes, for example, a program storage area and a data storage area. The program storage area and the data storage area can include combinations of different types of memory, such as read-only memory ("ROM"), random access memory ("RAM") (e.g., dynamic RAM ["DRAM"], synchronous DRAM ["SDRAM"], etc.), electrically erasable programmable read-only memory ("EEPROM"), flash memory, a hard disk, an SD card, or other suitable magnetic, optical, physical, or electronic memory devices or data structures. The processing unit 250 is connected to the memory 255 and executes software instructions that are capable of being stored in a RAM of the memory 255 (e.g., during execution), a ROM of the memory 255 (e.g., on a generally permanent basis), or another non-transitory computer readable medium such as another memory or a disc. Software included in the implementation of the industrial machine 10 can be stored in the memory 255 of the controller 200. The software includes, for example, firmware, one or more applications, program data, filters, rules, one or more program modules, and other executable instructions. The controller 200 is configured to retrieve from memory and execute, among other things, instructions related to the control processes and methods described herein. In other constructions, the controller 200 includes additional, fewer, or different components.

The power supply module 235 supplies a nominal AC or DC voltage to the controller 200 or other components or modules of the industrial machine 10. The power supply module 235 is powered by, for example, a power source having nominal line voltages between 100V and 240V AC and frequencies of approximately 50-60 Hz. The power supply module 235 is also configured to supply lower voltages to operate circuits and components within the controller 200 or industrial machine 10. In other constructions, the controller 200 or other components and modules within the industrial machine 10 are powered by one or more batteries or battery packs, or another grid-independent power source (e.g., a generator, a solar panel, etc.).

The user interface module 210 is used to control or monitor the industrial machine 10. For example, the user interface module 210 is operably coupled to the controller 200 to control the position of the dipper 50, the position of the boom 65, the position of the dipper handle 45, etc. The user interface module 210 includes a combination of digital and analog input or output devices required to achieve a desired level of control and monitoring for the industrial machine 10. For example, the user interface module 210 includes a display (e.g., a primary display, a secondary display, etc.) and input devices such as touch-screen displays, a plurality of knobs, dials, switches, buttons, etc. The display is, for example, a liquid crystal display ("LCD"), a light-emitting diode ("LED") display, an organic LED ("OLED") display, an electroluminescent display ("ELD"), a surface-conduction electron-emitter display ("SED"), a field emission display ("FED"), a thin-film transistor ("TFT") LCD, etc. The user interface module 210 can also be configured to display conditions or data associated with the industrial machine 10 in real-time or substantially real-time. For example, the user interface module 210 is configured to display measured electrical characteristics of the industrial machine 10, the status of the industrial machine 10, the position of the dipper 50, the position of the dipper handle 45, etc. In some implementations, the user interface module 210 is controlled in conjunction with the one or more indicators 205 (e.g., LEDs, speakers, etc.) to provide visual or auditory indications of the status or conditions of the industrial machine 10.

Figure 3:
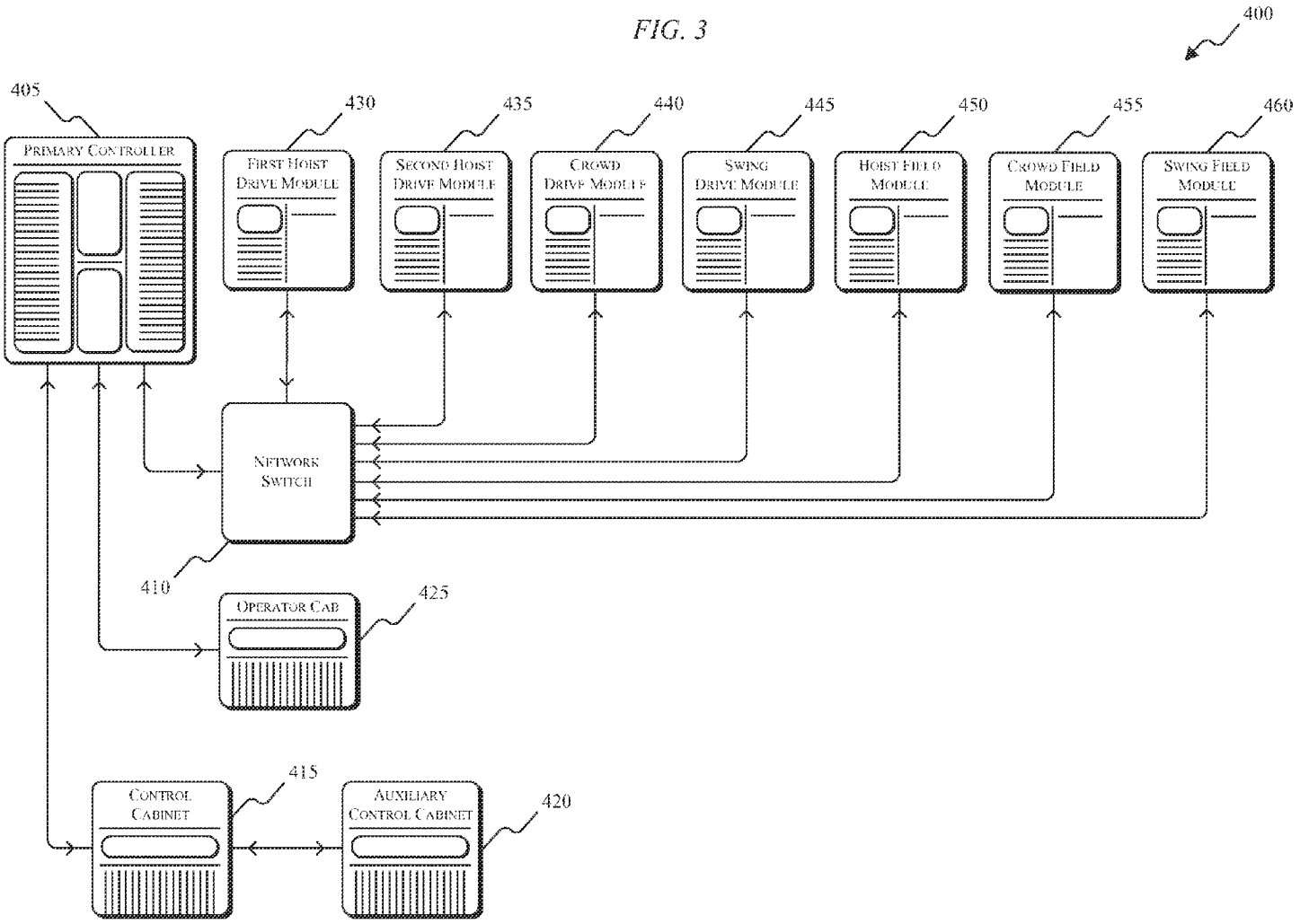
FIG. 3 illustrates a control system of the industrial machine of FIG. 1 according to another embodiment of the invention.

FIG. 3 illustrates a more detailed control system 400 for the industrial machine 10. For example, the industrial machine 10 includes a primary controller 405, a network switch 410, a control cabinet 415, an auxiliary control cabinet 420, an operator cab 425, a first hoist drive module 430, a second hoist drive module 435, a crowd drive module 440, a swing drive module 445, a hoist field module 450, a crowd field module 455, and a swing field module 460. The various components of the control system 400 are connected by and communicate through, for example, a fiber-optic communication system utilizing one or more network protocols for industrial automation, such as process field bus ("PROFIBUS"), Ethernet, ControlNet, Foundation Fieldbus, INTERBUS, controller-area network ("CAN") bus, etc. The control system 400 can include the components and modules described above with respect to FIG. 2. For example, the one or more hoist actuators and/or drives 215 correspond to first and second hoist drive modules 430 and 435, the one or more crowd actuators and/or drives 220 correspond to the crowd drive module 440, and the one or more swing actuators and/or drives 225 correspond to the swing drive module 445. The user interface module 210 and the indicators 205 can be included in the operator cab 425, etc. A strain gauge, an inclinometer, gantry pins, resolvers, etc., can provide electrical signals to the primary controller 405, the control cabinet 415, the auxiliary control cabinet 420, etc.

The first hoist drive module 430, the second hoist drive module 435, the crowd drive module 440, and the swing drive module 445 are configured to receive control signals from, for example, the primary controller 405 to control hoisting, crowding, and swinging operations of the industrial machine 10. The control signals are associated with drive signals for hoist, crowd, and swing actuators 215, 220, and 225 of the industrial machine 10. As the drive signals are applied to the actuators 215, 220, and 225, the outputs (e.g., electrical and mechanical outputs) of the actuators are monitored and fed back to the primary controller 405 (e.g., via the field modules 450-460). The outputs of the actuators include, for example, speed, torque, power, current, pressure, etc. Based on these and other signals associated with the industrial machine 10, the primary controller 405 is configured to determine or calculate one or more operational states or positions of the industrial machine 10 or its components. In some embodiments, the primary controller 405 determines a dipper position, a dipper handle angle or position, a hoist rope wrap angle, a hoist motor rotations per minute ("RPM"), a crowd motor RPM, a dipper speed, a dipper acceleration, etc.

The controller 200 and/or the control system 400 of the industrial machine 10 described above are used to control the operation of the industrial machine 10 based on, for example, a comparison of the actual performance of the industrial machine (e.g., an actual or monitored condition, characteristic, or parameter of the industrial machine) to operator-requested performance of the industrial machine (e.g., an operator-requested condition, characteristic or parameter of the industrial machine). The controller 200 is configured to determine, for example, whether a component or dipper drop condition is present, occurring, or has occurred based on the comparison of an actual parameter or characteristic of the industrial machine (e.g., an actual a hoist speed, hoist direction, motor torque, motor speed, dipper position, etc.) and a requested parameter or characteristic of the industrial machine (e.g., an actual a hoist speed, hoist direction, motor torque, motor speed, dipper position, etc.). In some embodiments, the presence of a hoist generating torque when a hoist motoring torque is expected can be used to identify a dipper drop condition. In other embodiments, hoist rope pay-out/pay-in can be monitored to identify a dipper drop condition (i.e., when the dipper 50 is moving in the wrong direction). When a dipper drop condition has been identified, the controller 200 and the control system 400 are configured to control or modify the performance of the industrial machine based on the identification of the dipper drop condition. For example, the controller 200 or control system 400 can modify a hoist parameter (e.g., a hoist torque, a hoist speed, a hoist motor current, etc.) of the industrial machine (e.g., of an actuator, a hoist actuator, a hoist motor, etc.) to prevent or mitigate the dipper drop condition.

Examples of such control are set forth with respect to the process 500, described below. The process 500 is associated with and described herein with respect to a digging operation and forces (e.g., hoist forces, etc.) applied during the operation. Although a variety of characteristics and/or parameters can be used to detect, prevent, and/or mitigate a dipper drop condition, the process 500 is described specifically with respect to monitoring a direction of hoist speed (e.g., dipper moving up or down) with respect to an operator requested direction for the hoist speed. Implementing the process 500 based upon a different characteristic and/or parameter (e.g., hoist speed, motor torque, motor speed, dipper position, etc.) would be known to one skilled in the art in view of the invention described herein. Various steps described herein with respect to the process 500 are capable of being executed simultaneously, in parallel, or in an order that differs from the illustrated serial manner of execution. The process 500 is also capable of being executed using fewer steps than are shown in the illustrated embodiment. For example, one or more functions, formulas, or algorithms can be used to modify the performance of the industrial machine to resolve or mitigate a dipper drop condition.

Figure 4:
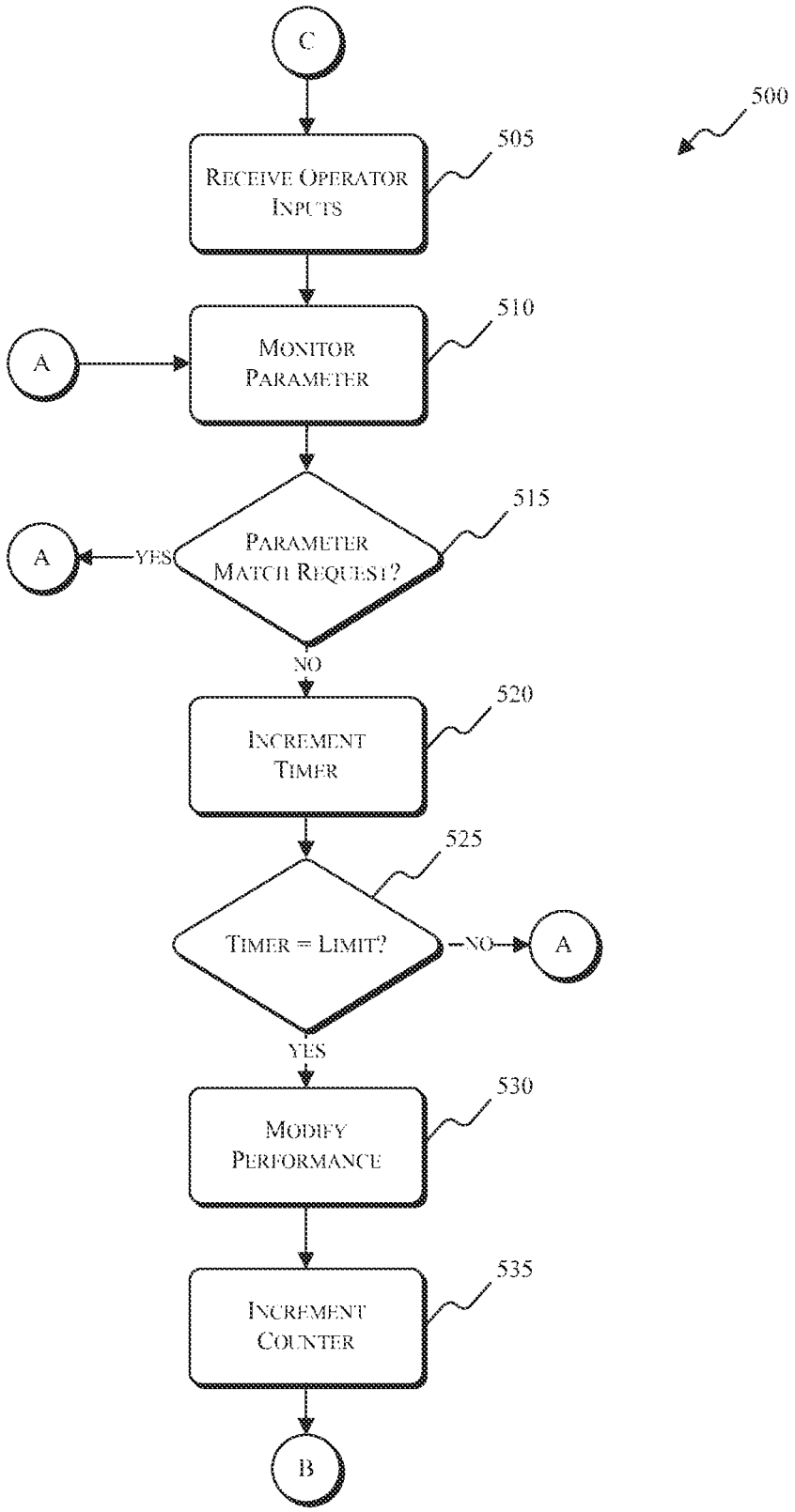
FIGS. 4 and 5 are a process for component or dipper drop detection and mitigation.
Figure 5:
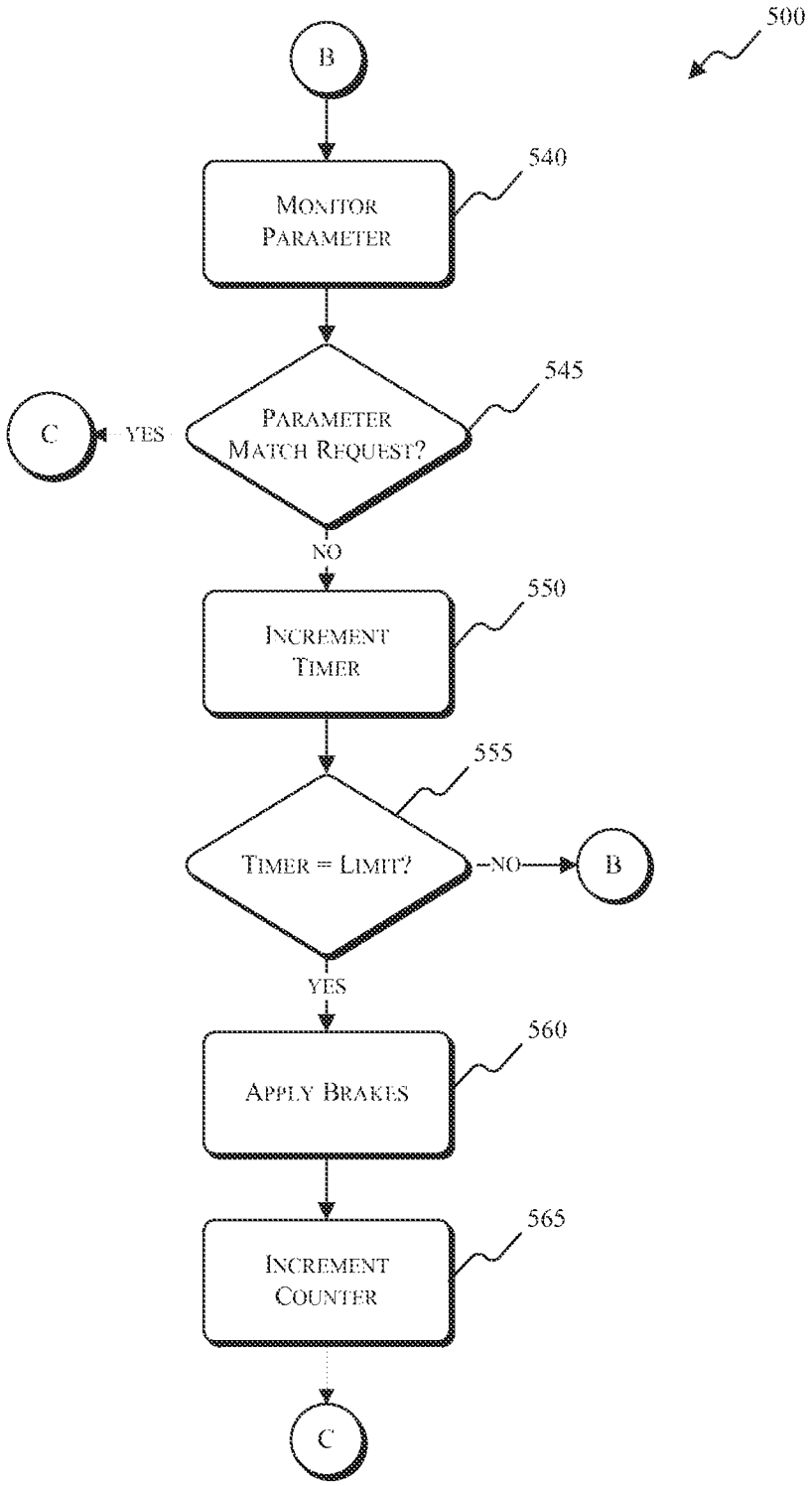

As illustrated in FIGS. 4 and 5, the process 500 begins at step 505 with the controller 200 receiving operator inputs for the industrial machine 10 via the user interface module 210. The operator inputs can include a requested crowd, hoist, and/or swing characteristic or parameter (e.g., velocity, speed, direction, torque, current, position, etc.). For example, a requested hoist parameter can include a requested position of the dipper 50 in a hoisting direction, a requested speed or direction of the hoist actuator 215, or a hoist torque of the hoist actuator 215, among other potential requested parameters. Based on the operator inputs (i.e., requested parameters), the controller 200 generates drive signals, as described above, for the hoist, crowd, and swing actuators 215, 220, and 225. At step 510, the corresponding operational characteristics or parameters (e.g., voltage, current, position, power, torque, speed, direction, etc.) of the actuators 215, 220, 225 or other sensors of the industrial machine (e.g., resolvers, inclinometers, etc.) are monitored and/or fed back to the controller 200.

Characteristics or parameters that can be monitored include a hoist motor speed, hoist torque, hoist direction, hoist motor current, etc. The hoist speed can be described as either positive or negative (i.e., greater than zero or less than zero) movement depending on the direction of rotation of the hoist motor 215. For example, an operator requested parameter corresponding to a negative value (i.e., a value less than zero) corresponds to a direction of movement of the dipper 50 toward the ground (i.e., down). An operator requested parameter corresponding to a positive value (i.e., a value greater than zero) corresponds to a direction of movement of the dipper 50 away from the ground (i.e., up). If, at step 515, the monitored direction of the hoist speed is negative when the requested direction of the hoist speed is zero or positive, a dipper drop condition may be present and the controller 200 increments or initiates a timer (step 520). If, at step 515, the monitored direction of the hoist speed matches the direction of the requested hoist speed, the process 500 returns to step 510 and continues to monitor the direction of the hoist speed.

If, at step 525, the timer has reached a first limit, a dipper drop condition has been detected or identified, the process 500 proceeds to step 530, and the performance of the industrial machine is modified (e.g., hoist torque is increased). Modifying the performance of the industrial machine can include a value for a parameter (e.g., of an actuator, hoist actuator, hoist motor, etc.) being set to a predetermined value or to a value that is determined as a proportion of the magnitude of a difference between the actual and requested performance. For example, a force or torque (e.g., a hoist force, a hoist torque, etc.) can be increased to a certain percentage or ratio of the normal or present (i.e., current) operating hoist torque (e.g., greater than or equal to 100% of a normal or maximum normal operating torque, to 100-150% of the normal operating torque, up to 300% of the normal operating torque, etc.). The percentage or ratio can either be a predetermined fixed value, such as can be applied to all dipper drop conditions regardless of the magnitude of difference between the actual and requested performance, or the percentage or ratio can be determined (e.g., calculated) proportionally to the magnitude of a difference between the actual and requested performance.

If, at step 525, the timer has not reached the first limit, the process 500 returns to step 510 where the actual parameters of the industrial machine are again monitored, and the actual direction of the hoist speed is compared to the requested direction of the hoist speed. Steps 510-525 are repeated until the requested and actual performance of the industrial machine match one another or the timer reaches the first limit. At step 535, the controller 200 increments a counter to keep a record of the number of dipper drop conditions that have been detected. In some embodiments, different counters can be used to keep track of dipper drop conditions based on severity. The process 500 then proceeds to section B shown in and described with respect to FIG. 5.

The controller 200 continues to monitor the actual direction of the hoist speed (step 540) and determines if the dipper drop condition has been cleared by determining if the actual direction of the hoist speed is still different from the requested direction of the hoist speed (step 545). If, at step 545, the direction of the monitored hoist speed matches the direction of the requested hoist speed, the dipper drop condition has been cleared and the process 500 returns to step 505 to wait to receive a new or updated operator input.

If, at step 545, the direction of movement of the dipper 50 is determined to be negative and the requested direction of movement of the dipper 50 is still zero or positive, the dipper drop condition has not been cleared. The controller 200 then increments or initiates a second timer (step 550) and compares a value of the timer to a second limit (step 555).

If the timer has not reached the second limit, the process 500 returns to step 540 where the direction of the hoist speed is continued to be monitored and compared to a requested direction for the hoist speed (step 545). If, at step 555, the timer has reached the second limit, the controller 200 sets or applies the hoist brakes for one or more of the hoist actuators 215 (step 560). A counter is then incremented (step 565) to indicate the number of instances where a dipper drop condition resulted in the application of the hoist brakes (i.e., modifying the performance of the industrial machine was insufficient to prevent or sufficiently mitigate the dipper drop condition).

In some embodiments, dipper drop conditions can be prevented or mitigated by adjusting one or more parameters of the industrial machine other than a hoist parameter (e.g., hoist torque). For example, if a dipper drop occurs as set forth above, the industrial machine can also execute a soft-lower of the dipper, crowd out the dipper to stall in a bank, or swing the dipper clear of a truck to protect the truck driver and the truck from injury or damage.

Thus, the invention provides, among other things, systems, methods, devices, and computer readable media for detecting and mitigating the effects of a dipper drop condition of an industrial machine based on a comparison of, for example, an actual hoist parameter and a requested hoist parameter. Various features and advantages of the invention are set forth in the following claims.

What is claimed is:

1. An industrial machine comprising:

a dipper;

a user interface operable to generate a first signal related to a requested direction of dipper movement based on an operator input;

a sensor operable to generate a second signal related to an actual direction of dipper movement;

a hoist actuator having a hoist force operating parameter; and a controller including a processor and executable instructions stored in a non-transitory computer readable medium, the controller operable to retrieve from the memory and execute the instructions to receive the first signal related to the requested direction of dipper hoist movement, receive the second signal related to the actual direction of dipper hoist movement, compare the requested direction of dipper hoist movement to the actual direction of dipper hoist movement to detect a dipper drop condition, the dipper drop condition being detected after the requested direction of dipper hoist movement is opposite the actual direction of dipper hoist movement, and modify a setting of the hoist force operating parameter of the hoist actuator after the dipper drop condition is detected.

2. The industrial machine of claim 1, wherein the hoist actuator is a hoist motor.

3. The industrial machine of claim 2, wherein the hoist force operating parameter of the hoist motor is a hoist torque.

4. The industrial machine of claim 1, wherein the controller is further configured to start a first timer after detecting the dipper drop condition.

5. The industrial machine of claim 4, wherein the modifying the setting of the hoist force operating parameter of the hoist actuator occurs after the first timer has reached a first time limit.

6. The industrial machine of claim 5, wherein the controller is further configured to start a second timer after the modifying the setting of the hoist force operating parameter of the hoist actuator.

7. The industrial machine of claim 6, wherein the controller is further configured to apply hoist brakes after the second timer has reached a second time limit.

8. A method of controlling an industrial machine including a dipper, the method comprising:

receiving, at a processor, a first signal related to an actual direction of dipper hoist movement from a sensor;

receiving, at the processor, a second signal related to a requested direction of dipper hoist movement based on an operator input to a user interface;

comparing, using the processor, the requested direction of dipper hoist movement to the actual direction of dipper hoist movement to detect a dipper drop condition, the dipper drop condition being detected after the requested direction of dipper hoist movement is opposite the actual direction of dipper hoist movement; and modifying, using the processor, a setting of a hoist force operating parameter of a hoist actuator after the dipper drop condition is detected.

9. The method of claim 8, wherein the hoist actuator is a hoist motor.

10. The method of claim 9, wherein the hoist force operating parameter of the hoist motor is a hoist torque.

11. The method of claim 8, further comprising starting a first timer after detecting the dipper drop condition.

12. The method of claim 11, wherein the modifying the setting of the hoist force operating parameter of the hoist actuator occurs after the first timer has reached a first time limit.

13. The method of claim 12, further comprising starting a second timer after the setting of the hoist force operating parameter of the hoist actuator.

14. The method of claim 13, further comprising applying hoist brakes after the second timer has reached a second time limit.

15. An industrial machine comprising:

a component;

a user interface operable to generate a first signal related to a requested direction of component hoist movement based on an operator input;

a sensor operable to generate a second signal related to an actual direction of component hoist movement;

an actuator having hoist force operating parameter; and a controller including a processor and executable instructions stored in a non-transitory computer readable medium, the controller operable to retrieve from the memory and execute the instructions to receive the first signal related to the requested direction of component hoist movement, receive the second signal related to the actual direction of component hoist movement, compare the requested direction of component hoist movement to the actual direction of component hoist movement to detect a component drop condition, the component drop condition being detected after the requested direction of component hoist movement is opposite the actual direction of component hoist movement, and modify a setting of the hoist force operating parameter of the actuator after the component drop condition is detected.

16. The industrial machine of claim 15, wherein the component is a dipper.

17. The industrial machine of claim 15, wherein the actuator is a hoist actuator.

18. The industrial machine of claim 17, wherein the hoist force operating parameter of the hoist actuator is a hoist force.

19. The industrial machine of claim 15, wherein the controller is further configured to start a first timer after detecting the component drop condition.

20. The industrial machine of claim 19, wherein the modifying the setting of the hoist force operating parameter of the actuator occurs after the first timer has reached a first time limit.

21. The industrial machine of claim 20, wherein the controller is further configured to start a second timer after the modifying the setting of the hoist force operating parameter of the actuator.

22. The industrial machine of claim 21, wherein the controller is further configured to apply brakes after the second timer has reached a second time limit.

* * * * *